US012396485B1

(12) United States Patent
Chen

(10) Patent No.: US 12,396,485 B1
(45) Date of Patent: Aug. 26, 2025

(54) ELECTRONIC ATOMIZER

(71) Applicant: Shenzhen Impetus Technology Co., Ltd., Guangdong (CN)

(72) Inventor: Liqian Chen, Guangdong (CN)

(73) Assignee: Shenzhen Impetus Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/979,711

(22) Filed: Dec. 13, 2024

(30) Foreign Application Priority Data

Oct. 11, 2024 (CN) ..... 202411414806.5

(51) Int. Cl.

| | |
|---|---|
| ***A24F 40/42*** | (2020.01) |
| ***A24B 7/00*** | (2006.01) |
| ***A24F 7/02*** | (2006.01) |
| ***A24F 9/00*** | (2006.01) |
| ***A24F 40/20*** | (2020.01) |
| ***A24F 40/485*** | (2020.01) |

(52) U.S. Cl.
CPC ..... *A24F 40/42* (2020.01); *A24B 7/00* (2013.01); *A24F 7/02* (2013.01); *A24F 9/00* (2013.01); *A24F 40/20* (2020.01); *A24F 40/485* (2020.01)

(58) Field of Classification Search
None
See application file for complete search history.

(56) References Cited

U.S. PATENT DOCUMENTS

| | | | | |
|---|---|---|---|---|
| 2013/0032159 | A1* | 2/2013 | Capuano | A24F 1/30 131/329 |
| 2018/0213847 | A1* | 8/2018 | Reevell | A24F 40/30 |
| 2019/0223503 | A1* | 7/2019 | Liu | A24F 7/00 |
| 2020/0237000 | A1* | 7/2020 | Stura | H05B 6/108 |
| 2023/0100436 | A1* | 3/2023 | Tran | A24F 40/46 131/329 |

FOREIGN PATENT DOCUMENTS

| | | | | |
|---|---|---|---|---|
| WO | WO-2019184468 | A1 * | 10/2019 | A24F 47/008 |

OTHER PUBLICATIONS

WO-2019184468-A1 English Translation obtained from Espacenet, pp. 1-16 (Year: 2025).*

* cited by examiner

*Primary Examiner* — Philip Y Louie
*Assistant Examiner* — Virginia R Bieger

(57) ABSTRACT

The present disclosure provides an electronic atomizer, including: a housing, provided with a first accommodating cavity, a second accommodating cavity, and an assembly cavity, where the first accommodating cavity extends facing an end part of the housing to form a first opening, the second accommodating cavity extends facing the end part of the housing to form a second opening, and the assembly cavity extends facing the end part of the housing to form a third opening; a cigarette paste cup and a paste cutting knife, the cigarette paste cup being disposed in the first accommodating cavity through the first opening, and the paste cutting knife being disposed in the second accommodating cavity through the second opening; and an atomization device, disposed in the assembly cavity through the third opening, where a first air passage is disposed in the assembly cavity, one end of which is communicated with the atomization device.

9 Claims, 8 Drawing Sheets

ELECTRONIC ATOMIZER

CROSS REFERENCE TO RELATED APPLICATIONS

The present application claims the benefit of Chinese Patent Application No. 202411414806.5 filed on Oct. 11, 2024, the contents of which are incorporated herein by reference in their entirety.

TECHNICAL FIELD

The present disclosure relates to the technical field of electronic atomizers, and in particular, to an electronic atomizer.

BACKGROUND

A current electronic atomizer generally atomizes cigarette oil to generate smoke to be then smoked by a user. As the development of electronic atomizer products, an electronic atomizer for atomizing a cigarette paste is researched and developed. At present, the cigarette paste is generally stored in an independent cigarette paste cup. When there is a need for smoking, a small piece is cut by a paste cutting knife from the cigarette paste cup into a cigarette paste atomizer of the electronic atomizer, but the cigarette paste cup and the paste cutting knife are both independent from the electronic atomizer, which is convenient for the user to use and carry.

SUMMARY

The present disclosure aims at providing an electronic atomizer, to solve the technical problem mentioned in the background art above.

The technical solution adopted by the present disclosure is an electronic atomizer, including:

- a housing, provided with a first accommodating cavity, a second accommodating cavity, and an assembly cavity, where the first accommodating cavity extends facing an end part of the housing to form a first opening, the second accommodating cavity extends facing the end part of the housing to form a second opening, and the assembly cavity extends facing the end part of the housing to form a third opening;
- a cigarette paste cup and a paste cutting knife, where the cigarette paste cup is disposed in the first accommodating cavity through the first opening, and the paste cutting knife is disposed in the second accommodating cavity through the second opening;
- an atomization device, disposed in the assembly cavity through the third opening, where a first air passage is disposed in the assembly cavity, one end of the first air passage is communicated with the atomization device, and the other end of the first air passage extends to a second end of the housing to form an air inlet hole; and
- a mouthpiece, detachably disposed on the housing, and communicated with a flue of the atomization device.

That is to say, in the electronic atomizer of the present application, the cigarette paste cup and the paste cutting knife can both be disposed in the housing, so that the cigarette paste cup and the paste cutting knife as well as the electronic atomizer are formed as a whole; when there is a need for smoking a cigarette, the paste cutting knife can be taken out from the second accommodating cavity of the housing, the mouthpiece is detached from the housing, the cigarette paste in the cigarette paste cup on the housing is cut by the paste cutting knife, the cut cigarette paste is placed in the atomization device, and the mouthpiece is mounted back on the housing. In this way, the user can suction the smoke generated through atomization by the atomization device by means of the mouthpiece. This structure can facilitate the user to carry the electronic atomizer capable of atomizing the cigarette paste.

BRIEF DESCRIPTION OF DRAWINGS

In order to more clearly illustrate the technical solutions in the embodiments of the present disclosure, the accompanying drawings required to be used in the embodiments or prior art description are briefly introduced below. Obviously, the accompanying drawings described below are only some embodiments of the present disclosure. For a person having ordinary skill in the art, without creative effort, other accompanying drawings can also be obtained according to these accompanying drawings.

REFERENCE NUMERALS

Figure 1:
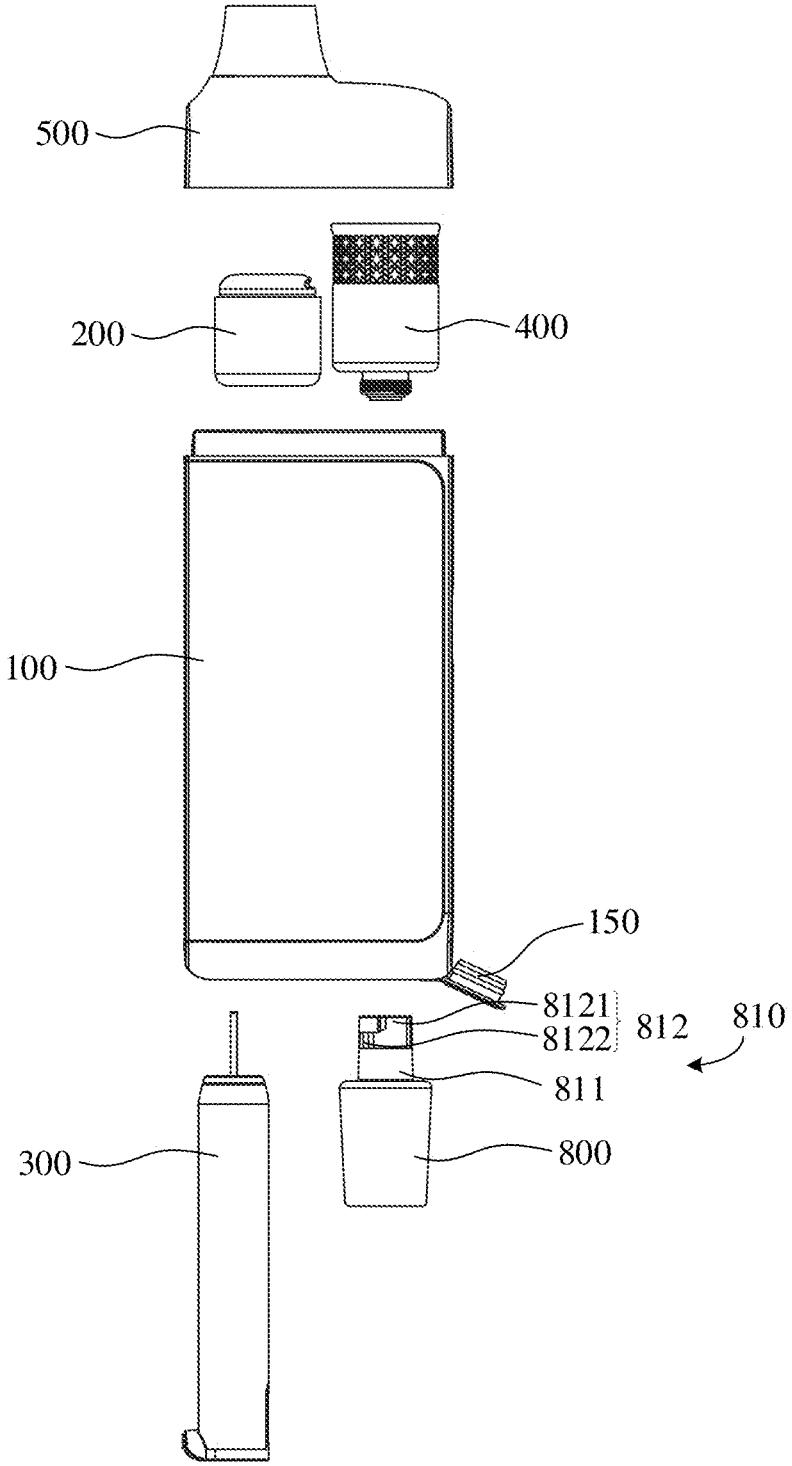
FIG. 1 is a decomposition schematic diagram of an electronic atomizer provided by the present disclosure.
Figure 2:
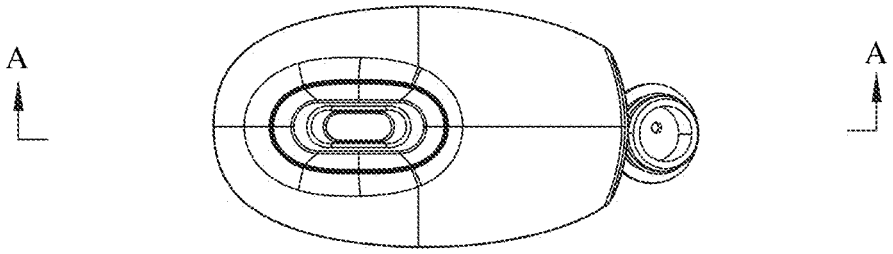
FIG. 2 is a top view of an electronic atomizer provided by the present disclosure.

100, housing; 110*a*, first accommodating cavity; 110*b*, second accommodating cavity; 110*c*, assembly cavity; 120, first air passage; 130*a*, first threaded seat; 130*b*, first electrode; 130*c*, first insulating member; 130*d*, vent hole; 140, second connecting member; 150, cover body; 160, second elastic contact point; 170, second clamping and holding portion; 180, blocking member; 181, clearance hole;

200, cigarette paste cup; 210, carrying cup body; 220, cup cover; 230*a*, first magnetic member; 230*b*, second magnetic member; 240, avoidance slot;

300, paste cutting knife; 310, first elastic contact point; 320, outer shell; 330, blade; 340, control board; 350, second battery; 360, first clamping and holding portion; 370, friction portion;

400, atomization device; 410, first atomization cup; 420, second atomization cup; 430, heating body; 440, smoke forming chamber; 450, first atomization passage; 460*a*, first atomization hole; 460*b*, second atomization hole; 460*c*, third atomization hole; 460*d*, fourth atomization hole; 470*a*, second threaded seat; 470*b*, second electrode; 470*c*, second insulating member;

500, mouthpiece; 510, mouth cover; 520, nozzle; 530, air passage member; 540, second air passage; 550, air inlet portion; 560, smoke inlet passage;

600, main board; 700, first battery; and

800, adapter; 810, first connecting member; 811, adapter ring; 812, first clamping and holding slot; 8121, first clamping slot; 8122, second clamping slot.

DETAILED DESCRIPTION

To make the technical problem to be solved, technical solutions, and beneficial effects of the present disclosure clearer and more understandable, the present disclosure is further explained in detail in conjunction with the accompanying drawings and embodiments. It should be understood that the specific embodiments described herein are merely intended to illustrate the present disclosure, and are not used to limit the present disclosure.

It should be explained that, when a component is referred to as "fixed to" or "disposed on" another component, it can be directly or indirectly placed on the other component. When a component is referred to as "connected to" another component, it can be directly or indirectly connected to the other component.

It should be understood that, orientation or position relationships indicated by terms "length", "width", "up", "down", "front", "rear", "left", "right", "vertical", "horizontal", "top", "bottom", "inside", "outside", and the like are orientation or position relationships shown in the drawings, and are only intended to facilitate to describe the present disclosure and simplify the description, rather than indicating or implying that a device or component referred to necessarily has a specific orientation and is configured or operated at a specific orientation, and therefore, they cannot be understood as limiting to the present disclosure.

In addition, terms "first" and "second" are only intended for the purpose of description, and cannot be understood as indicating or implying relative importance or implying or pointing out the number of the indicated technical features. Hence, there may clearly or impliedly be one or more of the features defined by "first" and "second". In some invention descriptions, the meaning of "a plurality of" refers to two or more, unless otherwise clearly and specifically defined.

With reference to FIG. 1 to FIG. 4, an electronic atomizer includes a housing 100, a cigarette paste cup 200, a paste cutting knife 300, an atomization device 400, and a mouthpiece 500.

Figure 4:
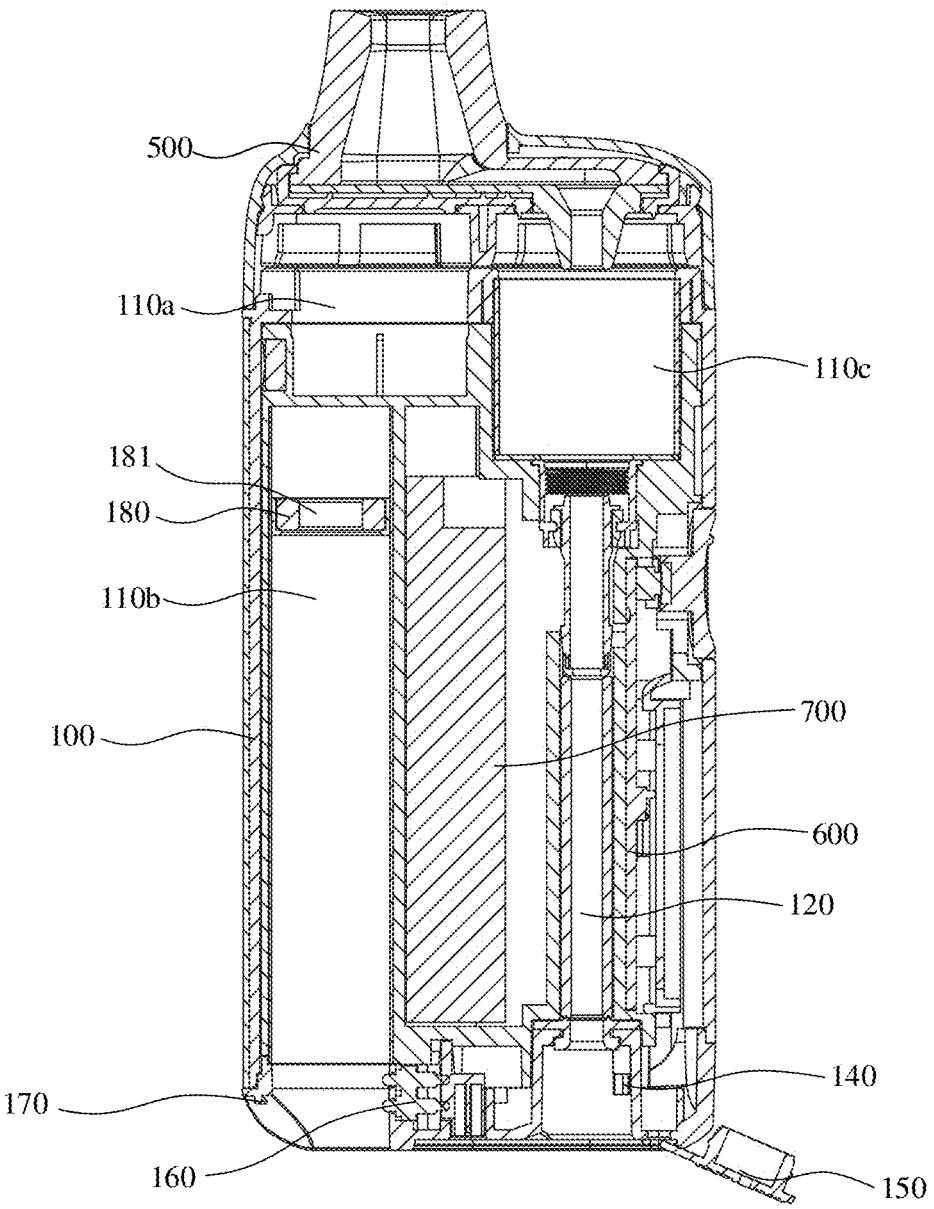
FIG. 4 is a sectional view after a cigarette paste cup, an atomization device, and a paste cutting knife are hidden in FIG. 3.

With reference to FIG. 4, the housing 100 is provided with a first accommodating cavity 110*a*, a second accommodating cavity 110*b*, and an assembly cavity 110*c*, where the first accommodating cavity 110*a* extends facing an end part of the housing 100 to form a first opening, the second accommodating cavity 110*b* extends facing the end part of the housing 100 to form a second opening, and the assembly cavity 110*c* extends facing the end part of the housing 100 to form a third opening.

Figure 3:
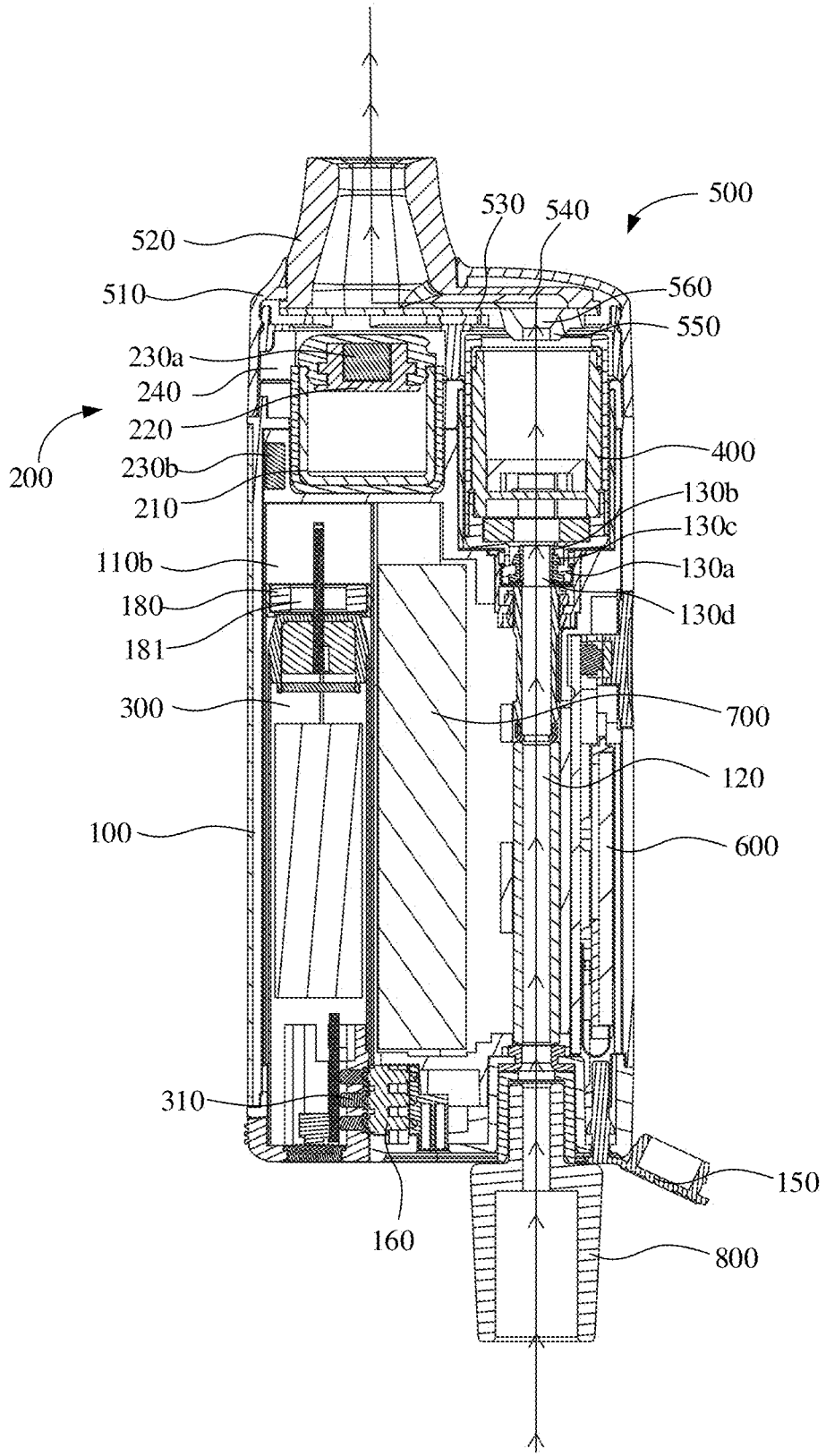
FIG. 3 is a sectional view at spot A-A in FIG. 2.

With reference to FIG. 1 and FIG. 3, the cigarette paste cup 200 is disposed in the first accommodating cavity 110*a* through the first opening, and the paste cutting knife 300 is disposed in the second accommodating cavity 110*b* through the second opening. The cigarette paste cup 200 is used for carrying a cigarette paste. The paste cutting knife 300 is used for cutting the cigarette paste in the cigarette paste cup 200, and placing the cut cigarette paste into the atomization device 400.

The atomization device 400 is disposed in the assembly cavity 110*c* through the third opening, and a first air passage 120 is disposed in the assembly cavity 110*c*, where one end of the first air passage 120 is communicated with the atomization device 400, and the other end of the first air passage 120 extends to a second end of the housing 100 to form an air inlet hole.

The mouthpiece 500 is detachably disposed at the end part of the housing 100, where the mouthpiece 500 is communicated with a flue of the atomization device 400.

For example, when there is a need for smoking a cigarette, the paste cutting knife 300 can be taken out from the second accommodating cavity 110*b*, and the mouthpiece 500 is detached from the housing 100; the cigarette paste in the cigarette paste cup 200 is cut by the paste cutting knife 300, the cut cigarette paste is placed into the atomization device 400, and then the mouthpiece 500 is mounted back on the housing 100, so that the mouthpiece 500 is communicated with the flue of the atomization device 400; the atomization device 400 heats the cigarette paste to generate smoke in the flue of the atomization device 400; during suctions of the user, an external air flow enters the first air passage 120 of the assembly cavity 110*c* through the air inlet hole; and the air flow in the first air passage 120 flows into the flue of the atomization device 400, and drives smoke to flow to the mouthpiece 500 for user suction.

That is to say, in the electronic atomizer of the present application, the cigarette paste cup and the paste cutting knife 300 can both be disposed in the housing 100, so that the cigarette paste cup and the paste cutting knife 300 as well as the electronic atomizer are formed as a whole; when there is a need for smoking the cigarette, the paste cutting knife 300 can be taken out from the second accommodating cavity 110*b* of the housing 100, the mouthpiece 500 is detached from the housing 100, the cigarette paste in the cigarette paste cup 200 on the housing 100 is cut by the paste cutting knife 300, the cut cigarette paste is placed in the atomization device 400, and the mouthpiece 500 is mounted back on the housing 100. In this way, the user can suction the smoke generated through atomization by the atomization device 400 by means of the mouthpiece 500. This structure can facilitate the user to carry the electronic atomizer capable of atomizing the cigarette paste.

With reference to FIG. 4, in some implementations, the first accommodating cavity 110*a* can extend facing a first end of the housing 100 to form a first opening, the second accommodating cavity 110*b* can extend facing a second end of the housing 100 to form a second opening, the assembly cavity 110*c* can extend facing the first end of the housing 100 to form a third opening, and the mouthpiece 500 is detachably disposed at the first end of the housing 100.

Preferably, when the mouthpiece 500 is disposed at the first end of the housing 100, the mouthpiece 500 can accommodate the cigarette paste cup 200 and the atomization device 400, and protect the cigarette paste cup 200 and the atomization device 400.

With reference to FIG. 3, to facilitate mounting and exchanging the atomization device 400 in the assembly cavity 110*c*, the assembly cavity 110*c* can further be internally provided with a first threaded seat 130*a* and a first electrode 130*b* disposed in the first threaded seat 130*a*, and a first insulating member 130*c* is disposed between the first threaded seat 130*a* and the first electrode 130*b*. The atomization device 400 is in threaded connection with the first threaded seat 130*a*, and the atomization device 400 is in contact with the first electrode 130*b*, so that the first threaded seat 130*a* and the first electrode 130*b* become positive and negative poles of the atomization device 400, to implement an electric connection after the atomization device 400 is mounted in the assembly cavity 110*c*.

Specifically, the electronic atomizer may further include a main board 600 and a first battery 700; the main board 600 and the first battery 700 are respectively disposed in the assembly cavity 110*c*, the first battery 700 is eclectically connected to the main board 600, and the main board 600 is electrically connected to the first threaded seat 130*a* and the first electrode 130*b*, respectively. By electrically connecting the main board 600 to the first threaded seat 130*a* and the first electrode 130*b*, the first battery 700 can supply power to the atomization device 400.

Further, a vent hole 130*d* is disposed at the first electrode 130*b*, and the vent hole 130*d* is communicated with the first air passage 120 and the flue of the atomization device 400, respectively. Specifically, the air flow in the first air passage 120 can flow into the flue of the atomization device 400 through the vent hole 130*d*.

In addition, in some implementations, the atomization device 400 of the present application can be a cigarette paste atomization device 400 or a cigarette oil atomization device 400. When the atomization device 400 is the cigarette paste atomization device 400, the cigarette paste atomization device 400 can be used for atomizing the cigarette paste. When the atomization device 400 is the cigarette oil atomization device 400 (a cigarette bomb), the cigarette oil atomization device 400 can be used for atomizing the cigarette oil.

That is to say, in some implementations, the electronic atomizer can implement atomization of the cigarette paste to generate smoke for user suction, and can also generate smoke from the cigarette oil for user suction. The user can select to mount different atomization devices 400 as needed, so that the user suction experience can be improved.

With reference to FIG. 1 and FIG. 3, the electronic atomizer may further include an adapter 800, where the adapter 800 is provided with a first connecting member 810, one end of the first air passage 120 close to the air inlet hole is provided with a second connecting member 140, the adapter 800 is disposed in the air inlet hole, and the adapter 800 is detachably connected to the second connecting member 140 through the first connecting member 810, and the adapter 800 is communicated with the first air passage 120 and the outside, respectively.

As can be understood, when the user normally uses the electronic atomizer, the user may make suction through the mouthpiece 500, and during suction, the external air flow may enter the first air passage 120 of the assembly cavity 110*c* through the air inlet hole; and the air flow in the first air passage 120 flows into the flue of the atomization device 400, and drives the smoke to flow to the mouthpiece 500 for user suction.

When the user wants to use an external filtering device (for example, a kettle) for filtering the smoke generated by the electronic atomizer first before suction, the adapter 800 can be mounted in the air inlet hole, and the adapter 800 is connected to the second connecting member 140 in the first air passage 120 through the first connecting member 810; and since the adapter 800 is further communicated with the first air passage 120 and the outside, respectively, at this time, the electronic atomizer can be connected to the filtering device through the adapter 800. In this way, when the user suctions a nozzle 520 on the filtering device, the external air flow enters the flue of the atomization device 400 through the mouthpiece 500; the smoke generated by the atomization device 400 flows into the filtering device along with the air flow through the first air passage 120 and the adapter 800; and after the smoke is filtered by the filtering device, it is suctioned by the user through the mouthpiece 500 of the filtering device, that is, a reverse cigarette suction of the electronic atomizer is implemented.

That is to say, when the user wants to normally suction the electronic atomizer, the air flow can flow through the air inlet hole, flows out through the first air passage 120 and the flue of the atomization device 400 in sequence, and is finally suctioned by the user through the mouthpiece 500.

When the electronic atomizer needs to be externally connected to one filtering device, one adapter 800 can be mounted at the air inlet hole; the adapter 800 can facilitate the connection to the filtering device. At this time, the air flow can flow out through the mouthpiece 500, the flue of the atomization device 400, the first air passage 120, and the adapter 800 in sequence, and finally flow to the filtering device, so as to implement the reverse cigarette suction of the electronic atomizer.

In some implementations, to facilitate connection between the adapter 800 and the second connecting member 140 through the first connecting member 810, the first connecting member 810 may include an adapter ring 811; the adapter ring 811 is disposed on the adapter 800; a periphery wall of the adapter ring 811 is provided with a first clamping and holding slot 812; and when the adapter 800 rotates, the first clamping and holding slot 812 and the second connecting member 140 are clamped with each other. In this way, by clamping the first clamping and holding slot 812 with the second connecting member 140, detaching of the adapter 800 can be facilitated.

In addition, in some implementations, the second connecting member 140 may be a protrusion disposed on a side wall within one end of the first air passage 120 close to the air inlet hole, and the protrusion and the first clamping and holding slot 812 are clamped with each other. The first clamping and holding slot 812 may include a first clamping slot 8121 and a second clamping slot 8122 connected to each other. The first clamping slot 8121 extends in a flowing direction of an air flow, and the second clamping slot 8122 and the first clamping slot 8121 are vertical to each other. At this time, the second connecting member 140 (the protrusion) can be first inserted into the first clamping slot 8121, and then the second connecting member 140 (the protrusion) is clamped in the second clamping slot 8122 by means of rotating the adapter 800.

Further, a second end of the housing 100 may also be provided with a cover body 150 for opening or closing the air inlet hole; the cover body 150 is provided with a through hole (not shown in the drawings); and when the cover body 150 closes the air inlet hole, the through hole is communicated with the first air passage 120.

As can be understood that, since the air inlet hole can be mounted with the adapter 800, a hole diameter of the air inlet hole would generally be large. Hence, when no adapter 800 is mounted at the air inlet hole, the air inlet hole can be closed by the cover body 150, and the external air flow can flow into the first air passage 120 through the through hole. In this way, it can avoid excessive air flow amounts, while avoiding or reducing pollutants entering the first air passage 120 at the same time.

Figure 5:
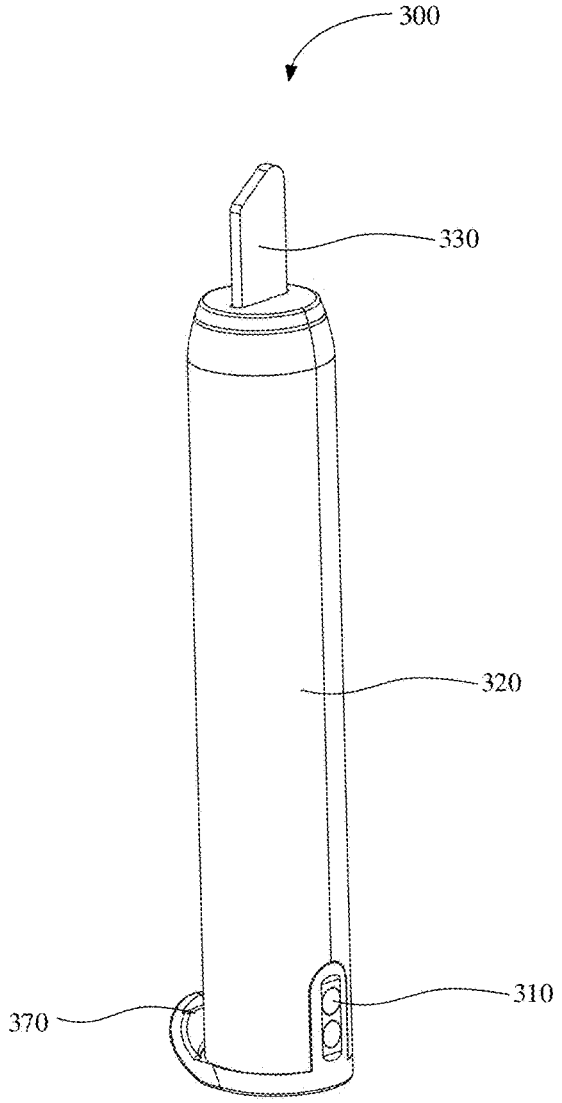
FIG. 5 is a schematic structural diagram of a paste cutting knife in an electronic atomizer provided by the present disclosure.

With reference to FIG. 3, FIG. 4, and FIG. 5, in some implementations, when the paste cutting knife 300 further has a heating function; a side wall of the paste cutting knife 300 can be provided with a first elastic contact point 310; a side wall of the first accommodating cavity 110*a* can be provided with a second elastic contact point 160; the second elastic contact point 160 is electrically connected to the main board 600; and when the paste cutting knife 300 is placed in the second accommodating cavity 110*b*, the first elastic contact point 310 is in contact with the second elastic contact point 160 to charge the paste cutting knife 300.

Figure 6:
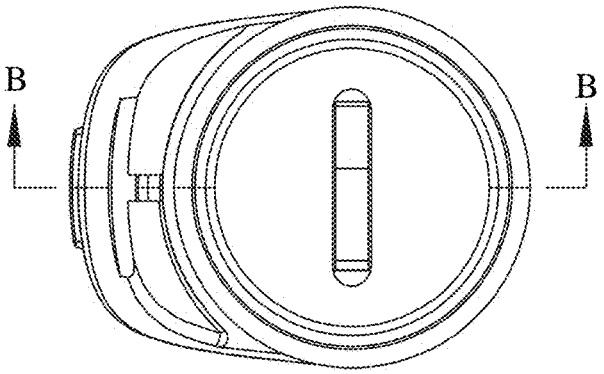
FIG. 6 is a top view of a paste cutting knife provided by the present disclosure.
Figure 7:
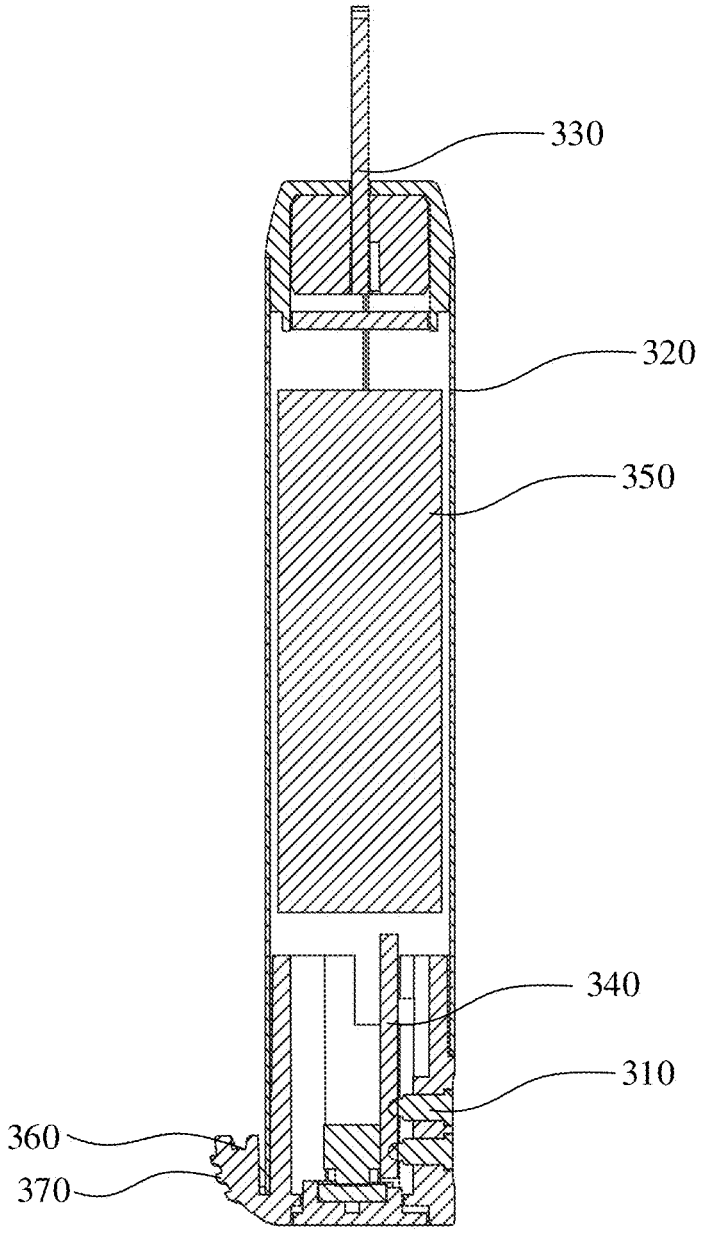
FIG. 7 is a sectional view at spot B-B in FIG. 6.

Specifically, with reference to FIGS. 6 and 7, in some implementations, the paste cutting knife 300 may include an outer shell 320, a blade 330, a control board 340, a first elastic contact point 310, and a second battery 350. The blade 330 is disposed at one end of the outer shell 320, and protrudes out of the outer shell 320, and the blade 330 is used for cutting an article; the control board 340 is disposed in the outer shell 320, and the control board 340 is electrically connected to the blade 330, so that the blade 330 is capable of emitting heat. The first elastic contact point 310 is disposed on a side wall of the outer shell 320, the second battery 350 is disposed in the outer shell 320, and the first elastic contact point 310 and the second battery 350 are electrically connected to the control board 340, respectively.

Specifically, the blade 330 can be disposed at one end of the outer shell 320; one end of the blade 330 extends to the outside of the outer shell 320 for cutting an article; and the other end of the blade 330 is used for being electrically connected to the control board 340.

After the paste cutting knife 300 is placed in the second accommodating cavity 110*b*, the first elastic contact point 310 is in contact with the second elastic contact point 160, so that the first battery 700 in the assembly cavity 110*c* can charge the second battery 350 of the paste cutting knife 300 through the control of the main board 600.

Further, the outer shell 320 may also be provided with a first clamping and holding portion 360; the housing 100 may further be provided with a second clamping and holding portion 170; when the paste cutting knife 300 is placed in the second accommodating cavity 110*b*, the first clamping and holding portion 360 and the second clamping and holding portion 170 are clamped with each other, to fix the paste cutting knife 300 in the second accommodating cavity 110*b*, to prevent the paste cutting knife 300 from falling from the second opening of the second accommodating cavity 110*b*.

Specifically, in some implementations, the first clamping and holding portion 360 may include a protrusion portion disposed on one side of the outer shell 320, and a second clamping and holding slot is disposed on an end surface of the protrusion portion. The housing 100 is provided with a clearance slot for avoidance of the protrusion portion; a second clamping and holding portion 170 is disposed at an end surface of the clearance slot; and when the paste cutting knife 300 is placed in the accommodating cavity, the second clamping and holding portion 170 and the second clamping and holding slot are clamped with each other.

Further, a friction portion 370 can also be disposed on a side surface of the protrusion portion. The friction portion 370 helps taking the paste cutting knife 300 clamped and fixed by the first clamping and holding portion 360 and the second clamping and holding portion 170 out from the second accommodating cavity 110*b*.

Specifically, the friction portion 370 may be a plurality of protrusions disposed at the side surface of the protrusion portion.

Further, a blocking member 180 may further be disposed in the second accommodating cavity 110*b*. When the paste cutting knife 300 is placed in the second accommodating cavity 110*b*, the blocking member 180 blocks one end, away from the first clamping and holding portion 360, in the paste cutting knife 300.

As can be understood, after the paste cutting knife 300 is placed in the second accommodating cavity 110*b*, one end of the paste cutting knife 300 is blocked and positioned through the blocking member 180, and the other end of the paste cutting knife 300 is clamped, cooperated, and fixed with the second clamping and holding portion 170 through the first clamping and holding portion 360, so as to fix the paste cutting knife 300 in the accommodating cavity, thereby avoiding wobble of the paste cutting knife 300 in the accommodating cavity.

Further, the blocking member 180 may be provided with a clearance hole 181; and when the blocking member 180 blocks the paste cutting knife 300, the clearance hole 181 allows the blade 330 of the paste cutting knife 300 to pass through, so as to prevent the blade 330 of the paste cutting knife 300 from being crushed by the blocking member 180.

With reference to FIG. 3, the cigarette paste cup 200 may include a carrying cup body 210, the carrying cup body 210 is disposed in the first assembly cavity 110*c*, a side wall of the carrying cup body 210 is provided with a cup cover 220 for opening or closing a cup opening of the carrying cup body 210, and the cup cover 220 is provided with a first magnetic member 230*a*. A side wall of the housing 100 is provided with a second magnetic member 230*b*; and when the cup cover 220 opens the cup opening of the carrying cup body 210, the first magnetic member 230*a* is mutually magnetized with the second magnetic member 230*b*.

As can be understood, the cigarette paste can be carried in the carrying cup body 210; after the cup cover 220 closes the cup opening of the carrying cup body 210, the cigarette paste can be sealed. After the cup cover 220 opens the cup opening of the carrying cup body 210, to avoid the cup cover 220 blocking the paste cutting knife 300 from cutting the cigarette paste, the first magnetic member 230*a* on the cup cover 220 can be magnetized with the second magnetic member 230*b* of the side wall of the housing 100, so that the cup cover 220 is fixed on the housing 100.

Further, a first end of the housing 100 can further be provided with an avoidance slot 240 for avoidance of the cup cover 220; and the avoidance slot 240 can facilitate opening of the cup opening of the cup cover 220, and avoid interferences with the housing 100 when the cup cover 220 is opened.

With reference to FIG. 3, the mouthpiece 500 may include a mouth cover 510, a nozzle 520, and an air passage member 530; the nozzle 520 and a ceramic member are detachably disposed on the mouth cover 510, respectively; and a second air passage 540 is formed at the nozzle 520 and the air passage member 530. The mouth cover 510 is detachably connected to the housing 100, and the mouth cover 510 is capable of covering the atomization device 400 and the cigarette paste cup 200. The second air passage 540 is communicated with the flue of the atomization device 400.

Specifically, the smoke in the flue of the atomization device 400 flows into the second air passage 540, and the user suctions the smoke in the second air passage 540 through the mouthpiece 500.

Further, the air passage member 530 may further be provided with a smoke inlet portion. When the mouth cover 510 is connected to the housing 100, the smoke inlet portion extends into the flue of the atomization device 400, and the smoke inlet portion is provided with a smoke inlet passage 560 for communicating the second air passage 540 and the flue of the atomization device 400.

Specifically, the smoke in the flue of the atomization device 400 flows into the second air passage 540 through the smoke inlet passage 560 to be suctioned by the user.

As can be understood, since the smoke inlet portion extends into the flue of the atomization device 400, it is ensured that the smoke in the flue can enter the smoke inlet passage 560 and flow into the second air passage 540.

In addition, since the nozzle 520 and the ceramic member are detachably disposed on the mouth cover 510, respectively, the nozzle 520 and the ceramic member can be detached from the mouth cover 510 for cleaning.

Further, in some implementations, a third magnetic member (not shown in the drawings) can be disposed on the mouth cover 510; a fourth magnetic member (not shown in the drawings) may be disposed on the housing 100; the mouth cover 510 implements detachable connection between the mouth cover 510 and the housing 100 through magnetism between the third magnetic member and the fourth magnetic member.

Figure 8:
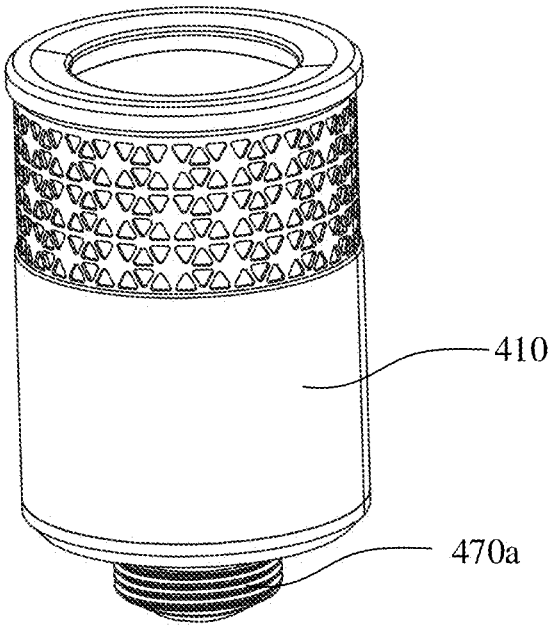
FIG. 8 is a schematic structural diagram of an atomization device in an electronic atomizer provided by the present disclosure.
Figure 9:
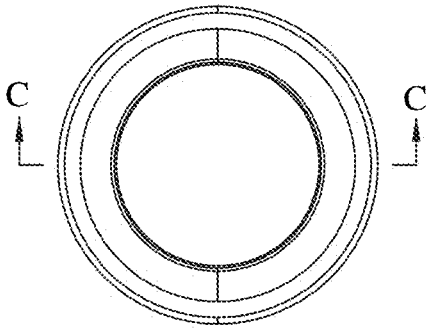
FIG. 9 is a top view of the atomization device provided by the present disclosure.
Figure 10:
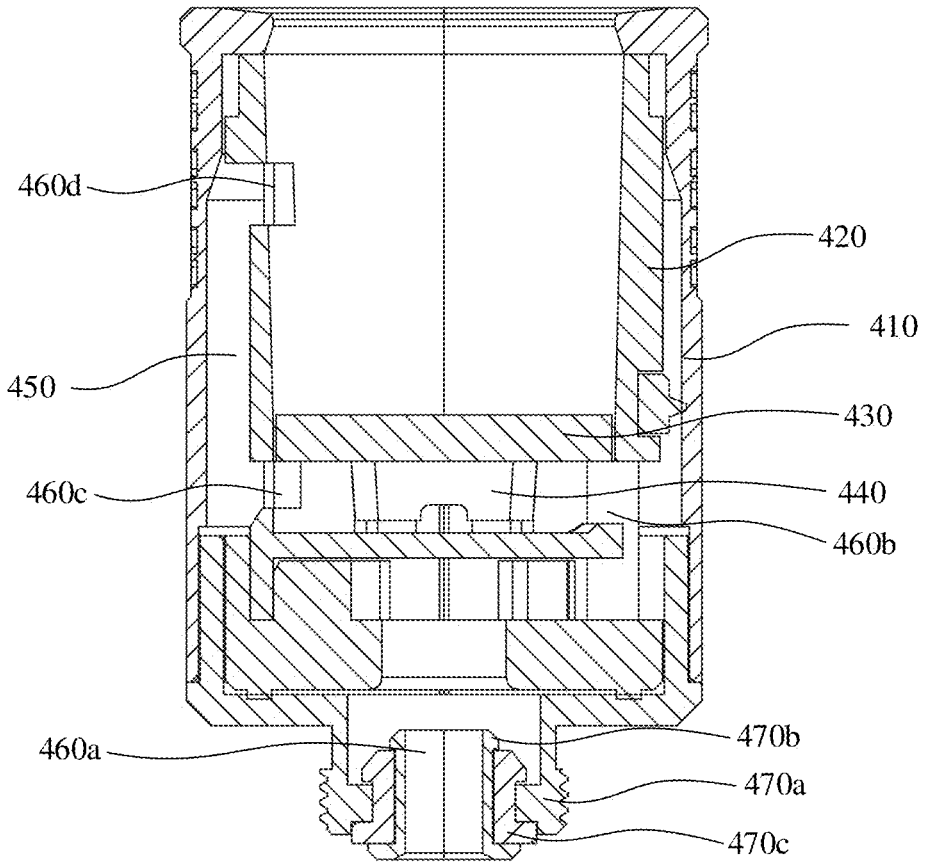
FIG. 10 a sectional view at spot C-C in FIG. 9.

With reference to FIG. 8 to FIG. 10, for example, in some implementations, when the atomization device 400 is the cigarette paste atomization device 400, the cigarette paste atomization device 400 may include a first atomization cup 410, a second atomization cup 420, and a heating body 430. The second atomization cup 420 is disposed in the first atomization cup 410, the heating body 430 is disposed in the second atomization cup 420, the second atomization cup 420 is used for placing the cigarette paste, and the heating body 430 heats and atomizes the cigarette paste to generate smoke.

Further, the heating body 430 may include a porous member (not shown in the drawings), the porous member is provided with a heating piece (not shown in the drawings); the porous member is disposed in the second atomization cup 420 and forms a smoke forming chamber 440 with a bottom of the second atomization cup 420; the porous member is used for carrying the cigarette paste; and after the cigarette paste is liquefied, it can enter the porous member to be in contact with the heating piece to generate smoke. The porous member may be integrally formed with the heating piece. For example, when the porous member is a porous ceramic, the porous member and the heating piece can be integrally sintered and formed.

Specifically, the cigarette paste can be placed into the second atomization cup 420 at the cup opening of the second atomization cup 420; the porous member located in the second atomization cup 420 carries the cigarette paste; when the heating piece emits heat, heat energy can be transferred onto the porous member; the heat energy on the porous member enables the smoke to be liquefied; the liquefied cigarette paste can enter the porous member from holes on the porous member to be in contact with the heating piece; the smoke is generated by atomization after the cigarette paste is in contact with the heating piece; and the smoke is gathered in the smoke forming chamber 440.

Further, a first atomization passage 450 is further disposed between the first atomization cup 410 and the second atomization cup 420; a first atomization hole 460*a* is disposed on the first atomization cup 410; a second atomization hole 460*b* and a third atomization hole 460*c* are respectively disposed on the second atomization cup 420; the second atomization hole 460*b* enables the first atomization hole 460*a* to be communicated with the smoke forming chamber 440, and the third atomization hole 460*c* enables the first atomization passage 450 to be communicated with the smoke forming chamber 440.

The air flow of the first air passage 120 enters the smoke forming chamber 440 through the first atomization hole 460*a* and the second atomization hole 460*b* in sequence, and drives the smoke in the smoke forming chamber 440 to discharge from the smoke forming chamber 440 to the mouthpiece 500 through the third atomization hole 460*c* and the first atomization passage 450 in sequence.

As can be understood that the first atomization hole 460*a*, the second atomization hole 460*c*, the smoke forming chamber 440, the third atomization hole 460*c*, and the first atomization passage 450 may form the flue of the cigarette paste atomization device 400.

The cigarette paste atomization device above could implement atomization of the cigarette paste to generate the smoke; the heating piece in a smoke sensing atomizer is not in direct contact with the cigarette paste; and by heating the cigarette paste through the porous member, the cigarette paste is liquefied to flow into the porous member and then in contact with the heating piece. In this way, an atomization speed of the heating piece on the cigarette paste can be controlled, and an excessive atomization speed of the heating piece on the cigarette paste affecting a taste and experience of smoking is avoided.

Further, to better control the atomization speed of the heating piece on the liquefied cigarette paste, and to facilitate gathering of the smoke in the smoke forming chamber 440, the heating piece can be disposed close to the smoke forming chamber 440.

For example, in some implementations, the heating piece can be located on an end surface of one end, close to the smoke forming chamber 440, of the porous piece. In other implementations, the heating piece can also be located, inside the porous piece, at one end of the porous piece close to the smoke forming chamber 440.

Further, in some implementations, to facilitate discharging of the smoke by the cigarette paste atomization device 400, and to facilitate the smoke discharged by the cigarette paste atomization device 400 entering the nozzle 520 at the same time, a fourth atomization hole 460*d* can also be formed in the side wall of the second atomization cup 420, the fourth atomization hole 460*d* is located one a side, away from the bottom of the second atomization cup 420, of the porous member, and the fourth atomization cup 460*d* enables the first atomization passage 450 to be communicated with a chamber of the second atomization cup 420.

Specifically, the smoke in the smoke forming chamber 440 is discharged from the third atomization hole 460*c*, the first atomization passage 450, and the fourth atomization hole 460*d* in sequence into the chamber of the second atomization cup 420, and finally flows from the cup opening of the second atomization cup 420 to the mouthpiece 500.

In the implementations above, the first atomization hole 460*a*, the second atomization hole 460*b*, the smoke forming chamber 440, the third atomization hole 460*c*, the first atomization passage 450, the fourth atomization hole 460*d*, the chamber of the second atomization cup 420, and the cup opening of the second atomization cup 420 may form the flue of the cigarette paste atomization device 400.

In some implementations, to facilitate the cigarette atomization device 400 to be detachably disposed in the assembly cavity 110*c*, the first atomization cup 410 may be provided with a second threaded seat 470*a*, a second electrode 470*b* is sleeved in the second threaded seat 470*a*, a second insulating member 470*c* is disposed between the second electrode 470*b* and the second threaded seat 470*a*, and the second electrode 470*b* is provided with the first atomization hole 460*a*. The heating piece is electrically connected to the second threaded seat 470*a* and the second electrode 470*b*, respectively, so that the second threaded seat 470*a* and the second electrode 470*b* form positive and negative poles of the heating piece. The heating piece can extend to form two conductive portions to be electrically connected to the second threaded seat 470*a* and the second electrode 470*b*, respectively.

When the cigarette paste atomization device 400 is connected to the assembly cavity 110*c*, the second threaded seat 470*a* can be in threaded connection with the first threaded seat 130*a* in the assembly cavity 110*c*; and at the same time, the second electrode 470*b* is in contact with the first electrode 130*b*, so as to achieve electric connection between the cigarette paste atomization device 400 and the main board 600 in the assembly cavity 110*c*.

The above-mentioned contents are only preferable embodiments of the present disclosure and are not intended to limit the present disclosure, and any modification, equivalent substitution, improvement, etc. made within the spirit and principles of some inventions shall all be included in the scope of protection of some inventions.

What is claimed is:

1. An electronic atomizer, comprising:

a housing, provided with a first accommodating cavity, a second accommodating cavity, and an assembly cavity, wherein the first accommodating cavity extends facing an end part of the housing to form a first opening, the second accommodating cavity extends facing the end part of the housing to form a second opening, and the assembly cavity extends facing the end part of the housing to form a third opening;

a cigarette paste cup and a paste cutting knife, wherein the cigarette paste cup is disposed in the first accommodating cavity through the first opening, and the paste cutting knife is disposed in the second accommodating cavity through the second opening;

an atomization device, disposed in the assembly cavity through the third opening, wherein a first air passage being disposed in the assembly cavity, one end of the first air passage is communicated with the atomization device, and the other end of the first air passage extends to a second end of the housing to form an air inlet hole;

a mouthpiece, detachably disposed on the housing, and communicated with a flue of the atomization device;

a main board and a first battery, wherein the main board and the first battery are respectively disposed in the assembly cavity, the first battery is electrically connected to the main board; and wherein a side wall of the paste cutting knife is provided with a first elastic contact point; a side wall of the first accommodating cavity is provided with a second elastic contact point; the second elastic contact point is electrically connected to the main board; and when the paste cutting knife is placed in the second accommodating cavity, the first elastic contact point is in contact with the second elastic contact point to charge the paste cutting knife.

2. The electronic atomizer of claim 1, wherein the assembly cavity is internally provided with a first threaded seat and a first electrode disposed in the first threaded seat, and a first insulating member is disposed between the first threaded seat and the first electrode;

the atomization device is in threaded connection with the first threaded seat, and the atomization device is in contact with the first electrode, so that the first threaded seat and the first electrode become positive and negative poles of the atomization device;

a vent hole is disposed at the first electrode, and the vent hole is communicated with the first air passage and the flue of the atomization device, respectively; and the main board, and the main board is electrically connected to the first threaded seat and the first electrode, respectively.

3. The electronic atomizer of claim 1, wherein the atomization device is a cigarette paste atomization device or a cigarette oil atomization device, the cigarette paste atomization device is used for atomizing a cigarette paste, and the cigarette oil atomization device is used for atomizing cigarette oil.

4. The electronic atomizer of claim 1, further comprising an adapter, wherein the adapter is provided with a first connecting member, one end of the first air passage close to the air inlet hole is provided with a second connecting member, the adapter is disposed in the air inlet hole, and the adapter is detachably connected to the second connecting member through the first connecting member, and the adapter is communicated with the first air passage and the outside, respectively.

5. The electronic atomizer of claim 4, wherein the first adapting member comprises an adapter ring, the adapter ring is disposed on the adapter, a periphery wall of the adapter ring is provided with a first clamping and holding slot, and when the adapter rotates, the first clamping and holding slot and the second connecting member are clamped with each other; and a second end of the housing is provided with a cover body for opening or closing the air inlet hole, the cover body is provided with a through hole, and when the cover body closes the air inlet hole, the through hole is communicated with the first air passage.

6. The electronic atomizer of claim 1, wherein the first accommodating cavity extends facing a first end of the housing to form a first opening, the second accommodating cavity extends facing a second end of the housing to form a second opening, the assembly cavity extends facing the first end of the housing to form a third opening, and the mouthpiece is detachably disposed at the first end of the housing; and when the mouthpiece is disposed at the first end of the housing, the mouthpiece is capable of accommodating the cigarette paste cup and the atomization device.

7. The electronic atomizer of claim 1, wherein the paste cutting knife comprises:

an outer shell;

a blade, disposed at one end of the outer shell, and protruding out of the outer shell, the blade being used for cutting an article;

a control board, disposed in the outer shell, the control board being electrically connected to the blade, so that the blade is capable of emitting heat; and a first elastic contact point and a second battery, wherein the first elastic contact point is disposed on a side wall of the outer shell, the second battery is disposed in the outer shell, and the first elastic contact point and the second battery are electrically connected to the control board, respectively.

8. The electronic atomizer of claim 1, wherein the cigarette paste cup comprises a carrying cup body disposed in the first assembly cavity, a side wall of the carrying cup body is provided with a cup cover for opening or closing a cup opening of the carrying cup body, and the cup cover is provided with a first magnetic member;

a side wall of the housing is provided with a second magnetic member, and when the cup cover opens the cup opening of the carrying cup body, the first magnetic member is mutually magnetized with the second magnetic member; and a first end of the housing is provided with an avoidance slot for avoiding the cup cover.

9. The electronic atomizer of claim 1, wherein the mouthpiece comprises a mouth cover, a nozzle, and an air passage member, the nozzle and a ceramic member are detachably disposed on the mouth cover, respectively, and a second air passage is formed at the nozzle and the air passage member;

the mouth cover is detachably connected to the housing, and the mouth cover is capable of covering the atomization device and the cigarette paste cup;

the second air passage is communicated with the flue of the atomization device; and the air passage member is further provided with a smoke inlet portion, when the mouth cover is connected to the housing, the smoke inlet portion extends into the flue of the atomization device, and the smoke inlet portion is provided with a smoke inlet passage for communicating the second air passage and the flue of the atomization device.

* * * * *